US006357455B1

(12) United States Patent
Duwendag et al.

(10) Patent No.: US 6,357,455 B1
(45) Date of Patent: Mar. 19, 2002

(54) PROCESS AND DEVICE FOR CLEANING AN ADHESIVE APPLICATOR

(75) Inventors: Ruediger Duwendag, Lengerich; Olaf Riedel, Horstmar, both of (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/450,132

(22) Filed: Nov. 26, 1999

(30) Foreign Application Priority Data

Nov. 26, 1998 (DE) ..... 198 54 621

(51) Int. Cl.[7] ..... B08B 9/093; B08B 3/00
(52) U.S. Cl. ..... 134/22.18; 134/34; 134/169 R
(58) Field of Search ..... 134/22.18, 34, 134/169 R

(56) References Cited

U.S. PATENT DOCUMENTS 4,419,141 A * 12/1983 Kunkel ..... 134/22.12

FOREIGN PATENT DOCUMENTS

DE 196 34 594 3/1998

* cited by examiner

*Primary Examiner*—Frankie L. Stinson
*Assistant Examiner*—Yolanda E. Wilkins
(74) *Attorney, Agent, or Firm*—Jabobson Holman, PLLC

(57) ABSTRACT

For cleaning an adhesive applicator with driven adhesive rollers, which can be rotated around vertical axes and which together with a housing, which is positioned at these adhesive rollers and whose side edges rest or almost rest against the adhesive rollers, forms an adhesive chamber, the adhesive is removed first from the adhesive chamber, for example by opening a floor seal. Then wash water is introduced into the adhesive chamber. The wash water is displaced into turbulent flows by driving the adhesive rollers alternating in opposite directions to each other. The wash water is drained after a fixed cleaning period.

4 Claims, 4 Drawing Sheets

PROCESS AND DEVICE FOR CLEANING AN ADHESIVE APPLICATOR

The invention relates to a process for cleaning an adhesive applicator with driven adhesive rollers, which can be rotated around vertical axes and which together with a housing, which is positioned at these adhesive rollers and whose side edges rest or almost rest against the adhesive rollers, forms an adhesive chamber.

This type of adhesive applicator is disclosed in the DE 196 34 594 A1. Adhesive applicators tend to get dirty and encrusted with adhesive residues so that it is necessary to clean the adhesive applicator at regular intervals and in particular before or after operating breaks. The cleaning of the adhesive applicator disclosed in the DE 196 34 594 A1 is facilitated by removing easily and rapidly the housing for the purpose of cleaning the adhesive applicator. However, it is unavoidable with the prior art adhesive applicator that a relatively time-consuming manual cleaning is necessary.

Therefore, the object of the invention is to provide a process of the aforementioned type that facilitates automatic cleaning of the adhesive applicator.

The invention solves this problem in that the adhesive is removed first from the adhesive chamber, and then wash water is introduced into the adhesive chamber and in that the wash water is displaced into turbulent flows by driving the adhesive rollers alternatingly in opposite directions to each other and then drained after a fixed cleaning period.

Before cleaning, the adhesive can be removed from the adhesive chamber by detaching a seal, for example, a plug, which is arranged in the floor of the adhesive chamber so that the adhesive that is still present in the adhesive chamber drains and is caught in the basin, arranged directly below the outlet opening. Then the cleaning begins by introducing the wash water.

To drain the adhesive that is still present in the adhesive chamber, the adhesive rollers can also be driven in the counter direction of rotation relative to the adhesive application. After this process the adhesive that is still present in the adhesive applicator or the adhesive chamber is drained in a first step by driving the adhesive rollers in the opposite direction, thus in a direction that is opposite to their direction of rotation relative to the application of the adhesive. Driving in this opposite direction causes the adhesive that is still present in the adhesive chamber to issue from the gap between the adhesive roller and the side edge of the housing, which is not positioned snugly against the adhesive roller or is provided with a doctor blade. The adhesive, issuing in a short period of time from the adhesive chamber, is caught in a basin situated below the adhesive applicator and is drained from this basin in the conventional manner. As soon as the adhesive that is still present is drained from the adhesive applicator, the wash water is introduced into the adhesive chamber. This wash water is displaced into turbulent flow by driving the adhesive rollers alternatingly in opposite directions to each other. The wash water runs by itself or by means of counter rotating adhesive rollers out of the adhesive chamber and is caught in the basin located below the adhesive applicator and is drained.

The cleaning effect can be significantly increased by driving the adhesive rollers at different velocities during the cleaning phase.

Furthermore, it is expedient to move the cleaning rollers apart temporarily during the cleaning phase in order to open the metering gap located between these two cleaning rollers.

The draining of the adhesive and the subsequent cleaning with wash water is done expediently according to a given program with fixed times, during which the adhesive is drained, the wash water is introduced and the adhesive rollers are driven in opposite directions. The individual phases of the wash procedure are controlled expediently by an electronic controller and/or a microcomputer.

A device to carry out the process of the invention is characterized according to the invention in that the adhesive chamber, which has a solenoid operated valve controlled by an electronic controller or a microcomputer, is provided with a line to feed in the wash water, and that the speed and the adhesive rollers' direction of rotation and optionally their motion can be controlled by the electronic controller or the microprocessor in order to enlarge or decrease the metering gap between the adhesive rollers.

One embodiment of the invention is explained in detail below with reference to the drawings.

Figure 1:
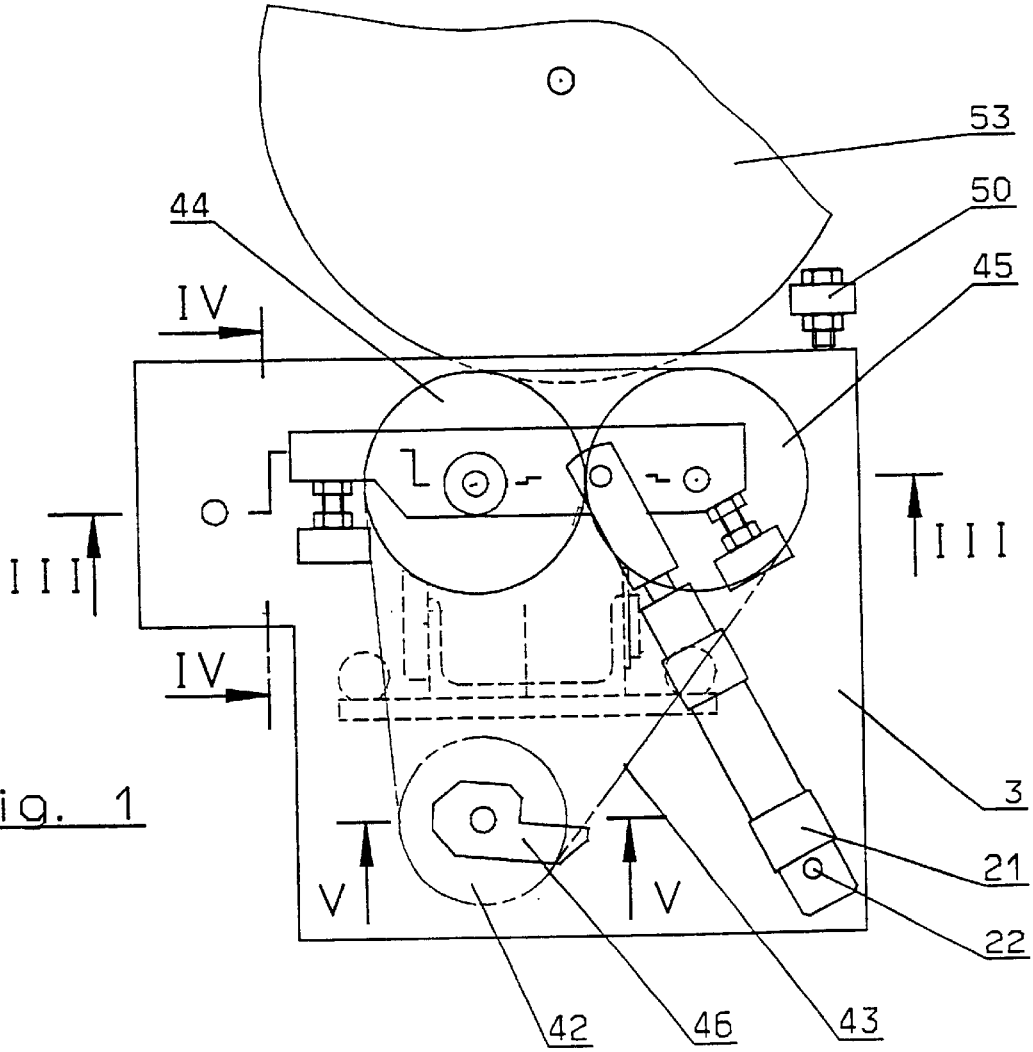
FIG. 1 is a top view of the adhesive applicator.
Figure 6:
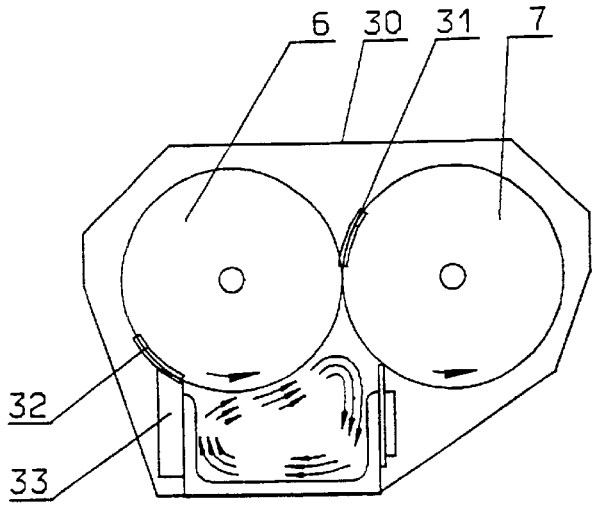
Figure 3:
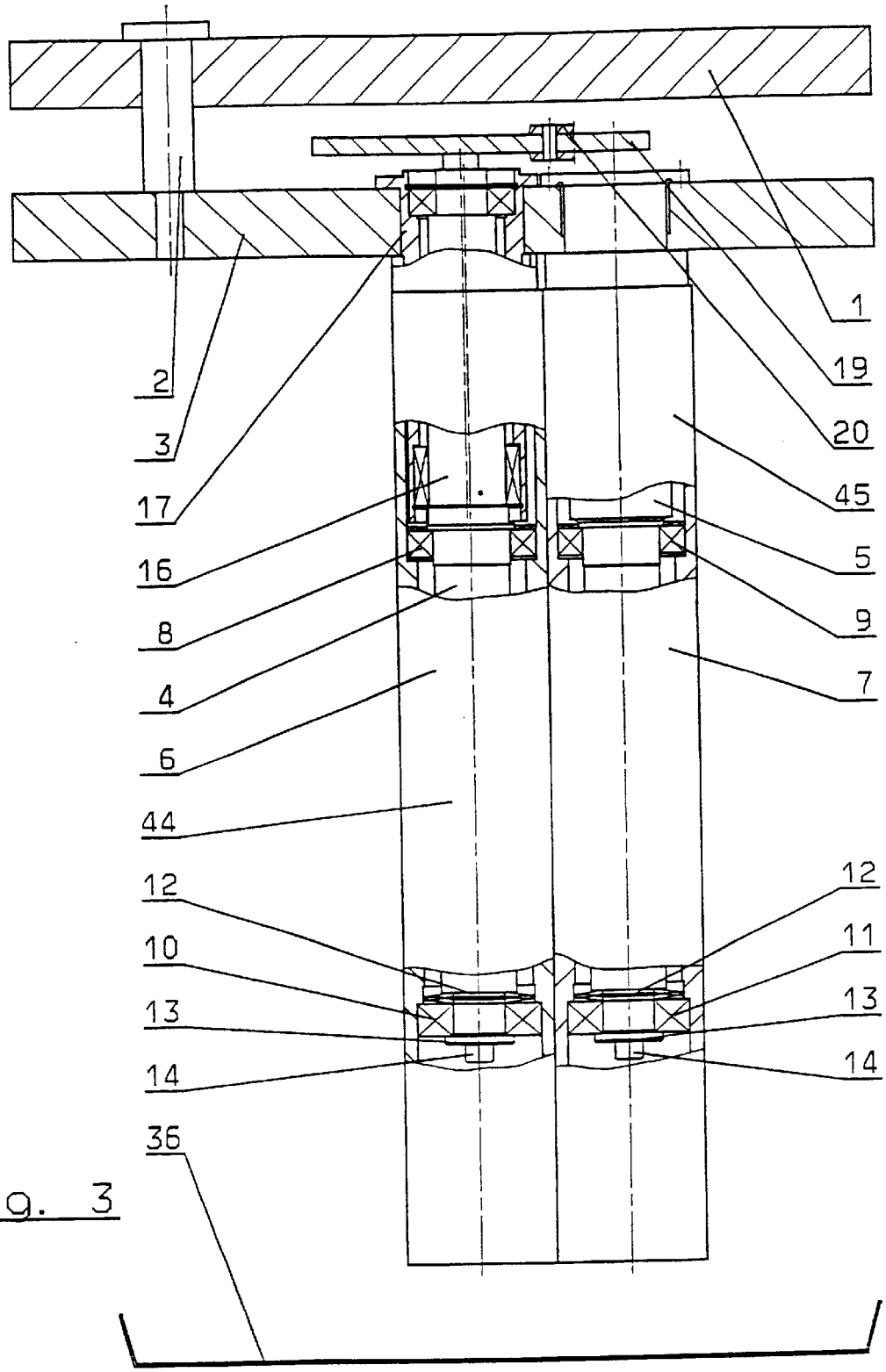
Figure 4:
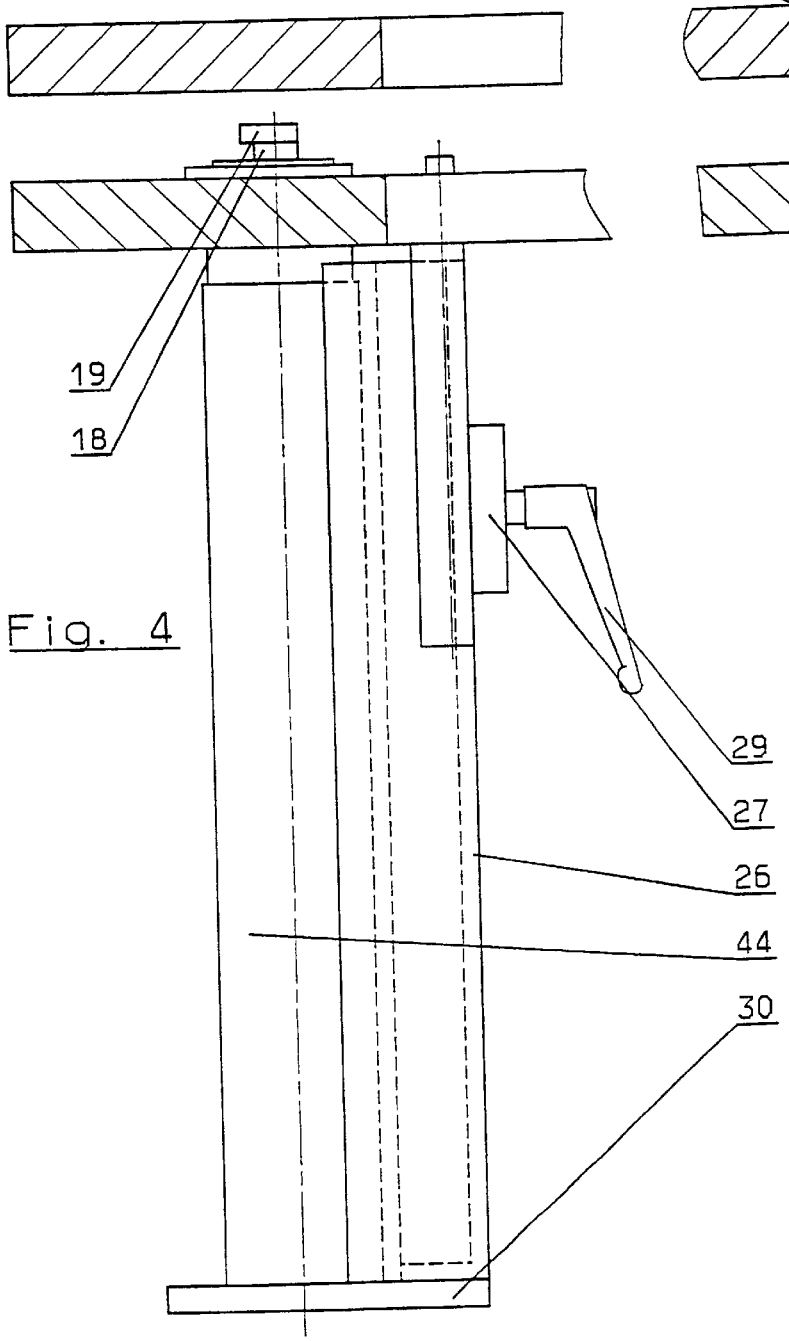
Figure 5:
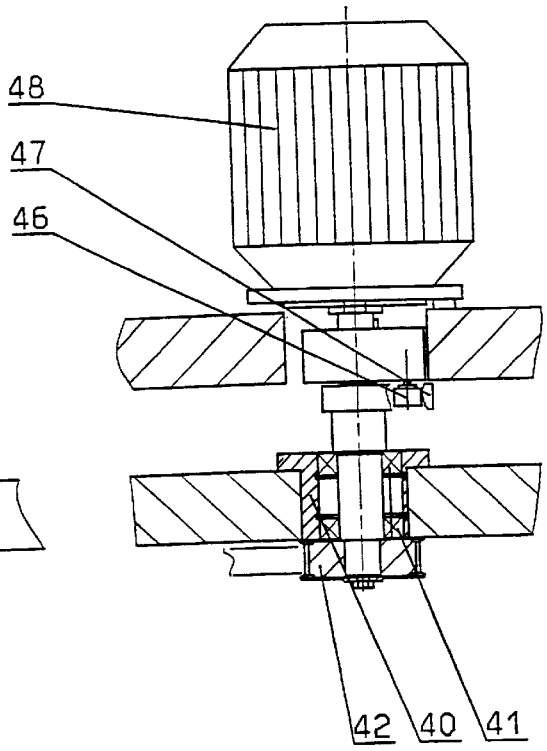

FIG. 3 is a cross sectional view of the adhesive applicator along the line III—III in FIG. 1, FIG. 4 is a side view of the adhesive applicator according to FIG. 3, FIG. 5 is a cross sectional view of the plate and the supporting plate according to FIGS. 3 and 4 with the drive of the adhesive applicator rollers, and FIG. 6 is a top view of the adhesive chamber of the adhesive applicator after removed supporting plate.

A supporting plate 3, which can be swivelled around a vertical bolt 2 and in which two bolts 4,5 are held parallel to each other, is mounted on a carrier or a plate 1 of a machine frame. On these bolts the adhesive applicator rollers 6, 7 are pivot-mounted by means of two roller bearings, and in particular by means of top moveable bearings 8,9 and bottom bearings 10,11, whose outer rings are fastened by means of clamping rings on an annular step of the adhesive rollers and whose inner rings are braced against the annular steps of the bolts by means of cup springs 12, where the inner rings of the roller bearings 10, 11 can be clamped using fastening screws 14 against the cup springs 12 by means of annular disks 13.

The bolt 4 is provided with a top segment 16, which is offset relative to said bolt and which can be rotated in a sleeve 17, fastened in a borehole of the supporting plate 3, but is mounted by means of roller bearings so as to be axially immoveable. On the pin 18 of the bolt 4, 16, which penetrates the supporting plate 3, is fastened a radial lever 19, to which the piston rod 20 of a pneumatic cylinder 21 is hinged that can be swivelled around the pin 22 on the supporting plate 3. The bolt 4 can be rotated by means of the pneumatic cylinder 21, so that the width of the gap, formed between the adhesive rollers 6, 7, can be adjusted and can also be completely closed.

Parallel to the bearing bolts 4,5, the mounting bolts 24,25, which serve to mount the housing 26 of the adhesive chamber, are fastened to the supporting plate 3. The rear wall of the housing 26 is connected to a transverse plate 27, whose two ends projecting beyond the housing are provided with fastening holes, through which fastening screws 28 are screwed into the threaded holes of the mounting bolts 24,25. Expediently the fastening screws 28 are designed as T-screws 29, as shown in FIG. 4.

The housing 26 exhibits a bottom stop plate 30, against which the bottom face side of the adhesive rollers 6, 7 rests sealingly. In the bottom plate 30 circular grooves 31, 32 are recesses into the outer edge of the face sides of the adhesive rollers 6, 7; these grooves rise liked wedges in the direction of the inlet-sided, vertical boundary edge of the side wall 33 of the housing 26 and in the direction of the roller gap.

Below the adhesive chamber is a basin 36, which serves to catch the dripping adhesive.

In the supporting plate 3 there is a shaft 41 in an eccentric sleeve 40. A gear belt pulley 42 is wedged on the bottom shaft pin, projecting beyond the supporting plate 3. Over the gear belt pulley 42 runs a continuous gear belt 43, which drives the gear belt pulley 44,45, connected to the adhesive rollers 6, 7.

A radial lever 46 is mounted on the pin of the shaft 41, projecting beyond the supporting plate 3. The shaft 41 is driven by means of said lever by means of an eccentric crankpin 47 of the motor 48, which is flanged to the plate 1 as shown in FIG. 3.

In the swivelled-in operating position the supporting plate 3 rests against the plate 1, which is permanently fastened to the frame, by means of a stop 50.

The adhesive roller 6 transfers the adhesive to the glue spreading roller 53. The adhesive roller 45, positioned at the adhesive roller 44, serves to spread and distribute the adhesive and to set the thickness of the transferred adhesive film in accordance with the width of the gap formed between the adhesive rollers.

The adhesive applicator described above matches the adhesive applicator according to DE 196 34 594 A1.

For the design and action of the adhesive applicator reference is made to the DE 195 32 582.6.

Figure 2:
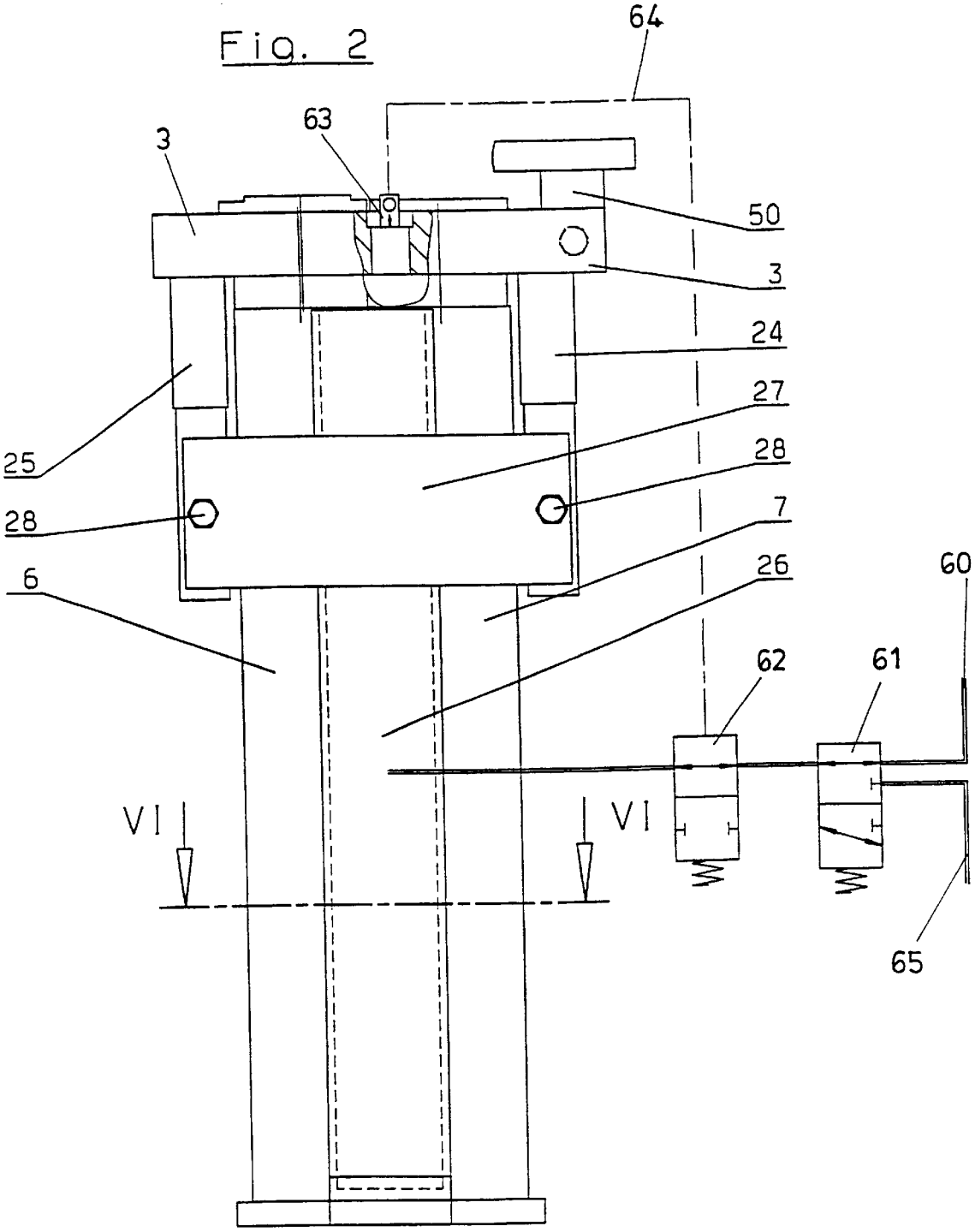
FIG. 2 is a rear view of the adhesive applicator according to FIG. 1.

In the case of the adhesive applicator the adhesive is fed through the line 60 and the solenoid valves 61 and 62 to the adhesive chamber. In the position shown in FIG. 2 the 3/2 solenoid valve 61 and the 2/2 solenoid valve 62 are connected so that the adhesive is fed to the adhesive chamber. The adhesive is supplied when the sensor 63, which is built into the supporting plate 3 and which can be an ultrasonic sensor, reports in such a manner a drop in the adhesive level that refilling must follow. The signals of the sensor 63 are sent over a line 64 to a microcomputer (not illustrated), which switches the solenoid valves 61 and 62 to filling the adhesive chamber when there is a need for adhesive.

Using the solenoid valves 61, 62, wash water can also be introduced through the line 65 into the adhesive chamber.

If the adhesive applicator is to be cleaned, the supply of adhesive to the adhesive chamber is interrupted by the electronic controller or the microcomputer. Then the motor 48 is reversed in its direction of rotation by means of the electronic controller or the microcomputer so that from the adhesive chamber the adhesive issues out of the gap between the vertical boundary edge of the side wall 33 of the housing 26 and the adhesive roller 6. The issuing adhesive is caught in the basin 36 and drained through lines that are not illustrated.

As soon as the adhesive has been drained from the adhesive chamber, the solenoid valves 61,62 are reversed in such a manner by means of the electronic controller or the microcomputer that wash water is introduced over the line 65 into the adhesive chamber. This wash water in the adhesive chamber is displaced into a turbulent flow by driving the adhesive rollers 6, 7 by means of the motor 48 alternatively in different directions of rotation and at different speeds. The result of said turbulent flow is that the housing, the adhesive rollers and the adjacent parts are cleaned well. The wash water that runs off is caught in the basin 36 and filled into containers over lines that are not illustrated.

To support the cleaning action, the rollers can be moved apart and together again using pneumatic cylinders 21, which can also be driven by the electronic controller or the microcomputer so that tentatively water can also issue from the metering gap.

The program for cleaning the adhesive applicator runs automatically so that the operator can effect the cleaning by merely depressing a bottom.

What is claimed is:

1. Process for cleaning an adhesive applicator with driven adhesive rollers (6, 7), which are rotated around vertical axes and which together with a housing (26), which is positioned at these adhesive rollers and whose side edges (33) rest or almost rest against the adhesive rollers (6, 7), forms an adhesive chamber, wherein that the adhesive is removed first from the adhesive chamber and then wash water is introduced into the adhesive chamber and in that the wash water is displaced into turbulent flows by driving the adhesive rollers (6, 7) alternatingly in opposite directions to each other and then drained after a fixed cleaning period.

2. Process, as claimed in claim 2, characterized in that the adhesive rollers (6, 7) are driven in the counter direction of rotation relative to the adhesive application so that the adhesive issues from the adhesive chamber.

3. Process, as claimed in claim 1, characterized in that the adhesive rollers (6, 7) are driven at different velocities during the cleaning phase.

4. Process, as claimed in claim 1, characterized in that the adhesive rollers are moved apart temporarily during the cleaning phase in order to open the metering gap.

* * * * *